US009572430B2

(12) United States Patent
Fischer

(10) Patent No.: US 9,572,430 B2
(45) Date of Patent: Feb. 21, 2017

(54) ITEM OF SEATING FURNITURE

(71) Applicant: VEL VEGA—DESIGN E TECNOLOGIA IND. UNIP. LDA., Funchal, Madeira (PT)

(72) Inventor: Matthias Fischer, Vienna (AT)

(73) Assignee: VEL VEGA—DESIGN E TECNOLOGIA IND. UNIP. LDA., Funchal, Madeira (PT)

( * ) Notice: Subject to any disclaimer, the term of this patent is extended or adjusted under 35 U.S.C. 154(b) by 0 days.

(21) Appl. No.: 14/760,332

(22) PCT Filed: Nov. 18, 2013

(86) PCT No.: PCT/EP2013/074096
§ 371 (c)(1),
(2) Date: Jul. 10, 2015

(87) PCT Pub. No.: WO2014/108230
PCT Pub. Date: Jul. 17, 2014

(65) Prior Publication Data

US 2015/0342352 A1 Dec. 3, 2015

(30) Foreign Application Priority Data

Jan. 11, 2013 (DE) ..... 10 2013 200 346

(51) Int. Cl.
*A47C 1/036* (2006.01)

(52) U.S. Cl.
CPC ..... *A47C 1/036* (2013.01)

(58) Field of Classification Search
CPC ..... A47C 1/036; A47C 7/38
(Continued)

(56) References Cited

U.S. PATENT DOCUMENTS 3,057,657 A * 10/1962 Fletcher ..... A47C 1/037 297/61
3,074,758 A 1/1963 Schliephacke
(Continued)

FOREIGN PATENT DOCUMENTS

| | | |
|---|---|---|
| DE | 1 429 273 | 2/1969 |
| DE | 94 20 616.3 U1 | 3/1995 |
| DE | 200 00 601 U1 | 4/2000 |

OTHER PUBLICATIONS

Form PCT/ISA/220 Notification of Transmittal of International Search Report issued in Application No. PCT/EP2013/074096 dated Jan. 24, 2014 (1 page).
(Continued)

*Primary Examiner* — Milton Nelson, Jr.
(74) *Attorney, Agent, or Firm* — Flynn, Thiel, Boutell & Tanis, P.C.

(57) ABSTRACT

An item of seating furniture, including a base, a seating unit, a backrest unit having a back contact surface, and a headrest unit with a head contact surface. The headrest unit is movable between a storage position and an operating position. The headrest unit is arranged in the storage position in such that the head contact surface is fully behind the back contact surface and below the top edge thereof. The headrest unit is pivotable about a headrest rotation axis along a nonlinear movement path, or is movable along a linear movement path opposite the base. The backrest unit is movable along a second movement path deviating from the movement path of the headrest unit, wherein the movement of the backrest unit is coupled to the movement of the headrest unit via a movement mechanism of the headrest unit.

19 Claims, 10 Drawing Sheets

(58) Field of Classification Search
USPC ..... 297/403, 61
See application file for complete search history.

(56) References Cited

U.S. PATENT DOCUMENTS

| | | | | | |
|---|---|---|---|---|---|
| 3,140,117 | A * | 7/1964 | Fletcher | A47C 1/037 | 297/403 |
| 3,836,197 | A | 9/1974 | Goff et al. | | |
| 5,346,277 | A * | 9/1994 | Holobaugh | A47C 1/037 | 297/396 |

OTHER PUBLICATIONS

Form PCT/ISA/210 International Search Report issued in Application No. PCT/EP2013/074096 with English translation of categories of documents cited dated Jan. 24, 2014 (4 pages).
Form PCT/ISA/237 Written Opinion of International Searching Authority issued in Application No. PCT/EP2013/074096 dated Jan. 24, 2014 (6 pages).
Office Action of German Patent Office issued in Application No. 10 2013 200 346.3 dated Oct. 28, 2013 (5 pages).

* cited by examiner

ITEM OF SEATING FURNITURE

AREA OF APPLICATION AND PRIOR ART

The invention relates to an item of seating furniture in the form of an upholstered sofa or upholstered armchair having a base, a seating surface unit, a backrest unit with a back contact surface, and a headrest unit with a head contact surface. In this context, the headrest unit of items of seating furniture of the type in question can be moved between a storage position and a functional position. In the functional position, the head contact surface is substantially aligned with the back contact surface to allow comfort when sitting. The headrest unit of items of seating furniture of the type in question is furthermore arranged in such a way in the storage position that the head contact surface is arranged completely behind the back contact surface and below the top edge of the back contact surface.

The invention furthermore also relates to a corresponding system of fittings for an item of seating furniture of this kind.

Sofas and armchairs of the type in question represent an alternative to sofas and armchairs which either do not have a headrest or have a fixedly integrated headrest which cannot be moved into a storage position. While armchairs and sofas without a headrest often do not allow fatigue-free sitting over a long period and can lead to neck ache, the aesthetic impression created by armchairs and sofas with an integrated headrest is often disadvantageous. As another variant, there is the possibility in the prior art of equipping items of seating furniture with a removable headrest. However, this leads to the obvious problem that the headrest has to be stored somewhere else when not mounted on the item of seating furniture.

Given this background situation, the already known items of seating furniture which are explained below form an alternative. With these, movability of the headrest unit with the head contact surface between a storage position and a functional position is provided. With such known items of seating furniture, the headrest unit is thus moved relative to the functional position in the storage position, the intention being, in particular, to reduce the height of the item of seating furniture and thus to improve the aesthetic impression when the headrest unit is not in use.

The most common commercially available design of such known items of seating furniture with a headrest unit which can be moved in a guided manner envisages that these headrest units are provided in the form of a surface-forming element, generally only thinly upholstered, which forms a horizontal upper end of the item of seating furniture at the back of the backrest unit and above the back contact surface in a storage position. However, the disadvantage of such designs lies primarily in the fact that the aesthetic freedom available in the design of such a headrest unit is very limited if said unit forms a different functional element of the sofa in the storage position, i.e. the upper end surface mentioned, for example. In particular, this design has the effect that the depth of the sofa beyond the back contact surface is also affected by the intended extent of the head contact surface in the functional position of the headrest unit. Once again, therefore, the effect is often an aesthetically disadvantageous impression.

The items of seating furniture of the type in question which were mentioned at the outset, in which the headrest unit is arranged behind the backrest in the storage position, from where it can be moved into the functional position, are furthermore known. DE 9420616 U1 and DE 20000601 U1 show such items of furniture, wherein an ability for translational movement of the headrest unit and also an ability for rotary movement are proposed here.

OBJECT AND SOLUTION

The object of the invention consists in developing an item of seating furniture of the type in question in such a way that it allows particularly convenient movement of the headrest unit.

According to the invention, this object is achieved by virtue of the fact that the headrest unit can be pivoted about a headrest rotation axis fixed in relation to the base along a nonlinear movement path, or can be moved along a linear movement path relative to the base. The backrest unit of the item of furniture according to the invention can furthermore be moved relative to the base along a second movement path deviating from the nonlinear or linear movement path of the headrest unit and is provided for manual movement. Here, the movement of the backrest unit is coupled to the movement of the headrest unit via a movement mechanism of the headrest unit.

In harmony with items of seating furniture of the type in question, an item of seating furniture according to the invention thus has a base, which, in particular, comprises those components which are provided for setting up the item of seating furniture, i.e. particularly the feet of the item of seating furniture. A seating surface unit, which is normally provided in a manner fixed in relation to the base but, in individual cases, can also be designed to be movable relative to the latter, is furthermore provided. Beyond each seating surface unit, the backrest unit is provided with the back contact surface mentioned. The head contact surface of the headrest unit is provided in a functional position above the back contact surface, thus allowing it to be used in an expedient way. In the functional position, the back contact surface and the head contact surface are flush with one another, this being intended to mean that they are arranged relative to one another so as to match the human anatomy. This generally means that central normal vectors on the back contact surface and the head contact surface enclose an angle of no more than 30° with one another.

In the context of the present description, the following should be noted: a vertical direction of an item of furniture is taken to mean a vertical direction in relation to the standing surface of the item of furniture. The transverse direction of an item of furniture is the direction in which the front end edge of a seating surface and the upper end edge of the backrest surface extend. The longitudinal direction of an item of furniture is the direction orthogonal to the vertical direction of an item of furniture and the transverse direction of an item of furniture. Where the term "forward" is used in the context of the longitudinal direction of the item of furniture, this means the direction from the backrest to the seating surface. Accordingly, "backward" means the opposite direction from the seating surface to the backrest. When relative arrangements are furthermore described by prepositions such as "above", "below", "behind" and "in front of" in the context of this description, this information in all cases relates only to one of the three basic directions and, unless stated otherwise, does not reveal anything about the other basic directions.

In the case of an item of seating furniture of the type in question, it is furthermore envisaged that the headrest unit is arranged in such a way in the storage position that the head contact surface is arranged completely behind the back contact surface in relation to the longitudinal direction of the furniture and completely below the top edge of the back contact surface in relation to the vertical direction of the furniture.

The movement mechanism of the item of seating furniture is advantageously designed in such a way that the headrest unit can be moved from the storage position into the functional position and from the functional position into the storage position along a nonlinear movement path.

A nonlinear movement path of this kind is regarded as any movement path which deviates from a purely linear alignment. By means of a nonlinear movement path, it is possible to achieve various designs which are advantageous in respect of the sequence of movement and/or the simplicity of the mechanism. In the context of the present invention, a movement mechanism for achieving a nonlinear movement path is taken to mean a movement mechanism in which the headrest unit as a whole describes such a movement path in a positively coupled manner, e.g. in that two superimposed movements in different directions which take place in succession or to different extents over the sequence of movement are positively coupled by the movement mechanism. In addition to such mobility of the headrest unit as a whole, it is furthermore possible in individual cases for further mobility which, in contrast, is not positively coupled, in particular adjustability of the alignment of the head contact surface, to be provided without this representing a departure from the solution according to the invention.

Instead of a nonlinear movement path, however, it is also possible for a linear movement path of the headrest unit to be provided. This could extend only in the vertical direction of the furniture, for example, in which case there is a need for forward mobility of the backrest unit in a manner positively coupled therewith or independent thereof, for transfer out of the storage position into the functional position. However, it is also possible, preferably likewise in combination with such mobility of the backrest unit, for a slanted linear movement path to be provided, by means of which the headrest is moved out of the storage position into the functional position while the alignment of the head contact surface preferably remains the same, in that it can be moved linearly forward in the longitudinal direction of the furniture and upward in the vertical direction of the furniture. Technically, a linear movement path is preferably achieved by means of a linear guide.

According to the invention, it is envisaged that the backrest unit of the item of furniture can be moved relative to the base along a second movement path deviating from the movement path of the headrest unit and is provided for manual movement. Here, the movement of the backrest unit is coupled to the movement of the headrest unit via the movement mechanism of the headrest unit.

According to the invention, the proposal is thus that the backrest forms an actuating means for moving the headrest. This can facilitate handling and, by avoiding direct manual handling of the headrest unit, can also improve the subjective impression of convenience.

The transition of the headrest unit between the functional position and the storage position is brought about by the manual handling of the backrest unit, in particular the manually effected pivoting thereof. To bring the headrest into the functional position, the backrest unit can be moved along its movement path. Through the coupling of the backrest unit to the movement mechanism of the headrest unit, said headrest unit is moved in the direction of the functional position along a path which deviates from the movement path of the backrest unit.

The arrangement of the head contact surface below the top edge of the back contact surface and behind the latter in the storage position of the headrest unit offers the possibility of concealing the headrest unit as a whole or at least the head contact surface thereof in the storage position, thus allowing the shaping of the head contact surface to be optimized purely with respect to its function in the functional position. In order to be able to store the headrest unit within a minimum space in its storage position, it is regarded as advantageous if the head contact surface encloses an angle of between 0° and 60°, in particular between 30° and 60°, with the vertical axis of the furniture in the storage position. In this case, the head contact surface can face forward or backward in the storage position of the headrest unit, depending on the type of movement mechanism.

Naturally, the head contact surface on items of seating furniture according to the invention is generally not completely flat. Insofar as angle data are given in relation to this or other surfaces which are not flat in practice in the context of this description, these data relate to a plane which is substantially parallel to the respective surface, the normal vector of which coincides with the central normal vector of the surface which is not completely level.

Said alignment of the head contact surface in the storage position leads to the head contact surface being arranged approximately parallel (+/−20°) to the back contact surface in the storage position of the headrest unit and thus enables it to be stored in a particularly space-saving manner.

In the functional position, the head contact surface preferably encloses an angle of between 0° and 30°, in particular between 0° and 15°, with the vertical direction of the furniture. Such an almost vertical alignment is economically advantageous. Despite said substantially flush arrangement of the back contact surface with the head contact surface in the functional position, it is regarded as advantageous if the head contact surface projects forward slightly beyond being exactly flush with the back contact surface. This too is taken to be substantially flush in the sense according to the present invention.

The movement mechanism which controls the transfer of the headrest unit and, in particular, defines the relevant movement path can be configured in many different ways. A comparatively complex design which may be advantageous is the design in which the headrest unit can be moved by means of two separate pivoted levers with the respective pivoting axes spaced apart from one another, which are secured on the backrest or the base, on the one hand, and on the headrest unit, on the other. By means of mutually differing lengths of these pivoted levers, it is possible to achieve a movement path by means of which the headrest unit is initially moved primarily upward in the vertical direction of the furniture and, toward the end of the sequence of movement, is moved primarily forward in the longitudinal direction of the furniture, during transfer into the functional position.

A particularly advantageous design from an economic point of view envisages that the headrest unit can be pivoted about a headrest rotation axis fixed in relation to the base or to the backrest unit. A rotation axis of this kind is preferably a rotation axis which extends in the transverse direction of the furniture and, in terms of design, is preferably formed by a torsion tube. Such pure pivotability of the headrest unit is highly robust and very simple and inexpensive to implement.

In order to be able to position the headrest unit and, in particular, the contact surface thereof as low as possible in the storage position in the case of a design with such a headrest rotation axis, it is advantageous if the headrest rotation axis is arranged below the top edge of the back contact surface, in particular preferably at least 10 cm below the top edge of the back contact surface. With such a design, it is advantageous, in particular, if the headrest unit has an upholstered headrest portion, which also includes the head contact surface, and furthermore has a headrest linkage, which provides the connection between the headrest portion and the headrest rotation axis, if appropriate in the form of said torsion tube.

In the design proposed here, provision is preferably made for the headrest unit to be pivotable through at least 90°, in particular preferably through at least 120°. In practice, pivoting angles between the storage position and the functional position of 135° (+/−10°) have also proven advantageous, in particular.

The pivoting direction of the headrest unit from the storage position into the functional position is preferably counterclockwise, in the transverse direction of the furniture based on a lateral perspective, in which the seating surface unit of the item of seating furniture is arranged on the right-hand side of the back contact surface, wherein the headrest unit is pivoted out of the storage position into the functional position. Based on the perspective of a user standing in front of the item of seating furniture, the headrest unit thus moves initially toward the user starting from the storage position, preferably until it has reached an approximately horizontal intermediate position, from which it then does continue to move upward but also simultaneously backward until it reaches the functional position.

Even with the preferred counterclockwise movement of the headrest unit out of the storage position into the functional position, a movement in the opposite direction can be advantageous in phases. Thus, the coupling between the backrest unit and the headrest unit can be such that, in the course of the overall movement of the backrest unit out of an initial position into a reversal position, explained below, and back into the initial position, the headrest unit is moved into the functional position but, during this process, is pivoted briefly clockwise in an initial phase or a final phase in order, for example, to come to rest from above on the backrest unit when said unit returns to the initial position.

Since, unlike known designs of items of seating furniture, the center of gravity of the headrest unit is moved comparatively far up in the vertical direction of the furniture during transfer into its functional position in many of the conceivable designs according to this invention, it is advantageous if the item of seating furniture has a first spring means, which subjects the headrest unit permanently to a force in the direction of its functional position. A spring means of this kind, which could be formed by a helical spring in a simple embodiment, for example, at least partially compensates for the mass of the headrest unit and thus allows smooth transfer into the functional position. Said spring is preferably comparatively long, in particular preferably longer than 30 cm, in order to ensure a spring force which varies only slightly in the range of use.

The spring is furthermore preferably designed and articulated in the item of furniture in such a way that it is capable of holding the headrest unit, counter to the weight of said unit, in an intermediate position between the storage position and the functional position, in particular an intermediate position, in which the head contact surface is aligned approximately horizontally (+/−20°). As an alternative or in addition, the spring can also be designed in such a way that it imposes a force in the functional position and preferably also in the direction of the functional position just before reaching the functional position. Although, in the functional position of the headrest unit, the spring is preferably already shortened relative to said intermediate position and the spring force is therefore reduced, both the above-described behavior in the intermediate position and the behavior in the functional position can be jointly achieved in the case of an item of furniture according to the invention since the moment in the direction of the storage position caused by the weight of the headrest unit can be very small in the functional position if the center of gravity of the headrest unit is no more than 10 cm, preferably no more than 5 cm, from the headrest pivoting axis in the functional position, based on the longitudinal direction of the furniture. Moreover, the attachment of the spring to the headrest unit can be arranged in such a way that the corresponding articulation point is further away from the headrest pivoting axis in the functional position than when the headrest unit is arranged in said intermediate position.

As regards the movement of the backrest unit relative to the base, this can be implemented in such a way in the simplest case that the backrest unit can be pivoted as a whole about a backrest axis fixed to the base. Since, in such a case, the pivoting axis of the backrest should be mounted well forward on the item of seating furniture in order to allow movement of the headrest unit on the forward-tilted backrest unit, another design is regarded as more advantageous, namely one in which the backrest unit is connected movably to the base by at least two main links. Here, the first main link is provided in such a way as to be pivotable about a first pivoting axis fixed in relation to the base and about a second pivoting axis fixed in relation to the backrest unit, while the second main link is pivotable about a third pivoting axis fixed in relation to the base and about a fourth pivoting axis fixed in relation to the backrest unit. The pivoting axes on the base side are spaced apart, as are the pivoting axes on the backrest side. By means of a double-link design of this kind, it is possible to ensure that the movement path along which the backrest unit can be moved is similar to that of a backrest axis arranged further forward without it requiring this axis. Instead, all four pivoting axes of the double-link system which have been mentioned are preferably arranged behind the back contact surface of the backrest unit, based on the longitudinal direction of the item of furniture. This allows the use of a comparatively compact fitting. If both main links are of identical length, this being taken in this context to mean the distance between the respective pivoting axes of the main links, the movement path of the backrest unit relative to the base is in the form of a circular segment while the alignment of the backrest unit is invariable. However, it is advantageous if the backrest unit is moved to a greater extent in an upper region during its movement than in a lower region in order, in particular, also to create sufficient space to move the headrest unit in the direction of its functional position or back into the storage position without collisions. For this purpose, provision is preferably made for one of the main links to be at least 20% longer than the other main link. The shorter main link is preferably the one which is arranged further back in the longitudinal direction of the furniture. The backrest unit, which is provided with double articulation on the base by the two main links, is therefore additionally pivoted while it is being moved along the movement path predetermined by the double link.

The compact construction of the fixing, which is made possible especially by the double link system, is advantageous especially since it entails hardly any consequential problems in respect of other components of the item of seating furniture. Thus, for example, no adaptations have to be made particularly in respect of the upholstery, which would make such an item of seating furniture more expensive.

It is regarded as particularly advantageous if, starting from the arrangement of the backrest unit in its normal position of use, a substantially linear movement phase occurs first of all during movement for the purpose of moving the headrest unit, and the backrest unit pivots to a greater extent only in the course of further movement. This can be achieved if the alignment of the two main links mentioned in the storage position or the functional position of the headrest unit and thus the position of use of the backrest unit is aligned substantially parallel (+/−15°).

It is preferable if not only a first main link and a second main link are provided but that preferably two first and two second main links are provided, which are each pivotable about identical pivoting axes and are arranged offset relative to one another in the transverse direction of the item of furniture, on both sides of the backrest unit which can be moved for the purpose of moving the headrest unit. To enforce uniform pivoting of both first main links and/or both second main links, the two first main links and/or the two second main links are preferably connected rigidly to one another in such a case. This is achieved, in particular, by means of a connecting rod which extends in the transverse direction of the item of furniture and connects the two first main links and the two second main links, respectively, in such a way that they only ever move together. The connecting rod or the connecting tube preferably extends coaxially with one of the pivoting axes of the main links concerned.

Of particular advantage in this context is a design in which the headrest unit has a torsion tube extending in the transverse direction of the furniture, which defines the headrest rotation axis and accommodates the connecting rod or connecting tube between the main links, which are of the same type. This torsion tube preferably extends coaxially with the headrest rotation axis.

As a particularly preferred option, one of the pivoting axes of one main link and the headrest rotation axis coincide.

To achieve the desired operative coupling between the movement of the backrest unit and of the headrest unit, it is particularly advantageous in the case of the double-link design mentioned if a connecting unit is provided between the second main link and the headrest unit, which is attached to the second main link in such a way as to be pivotable about a fifth pivoting axis offset relative to the third pivoting axis and which is attached to the headrest unit in such a way as to be pivotable about a sixth pivoting axis offset relative to the headrest rotation axis.

In this case, two designs are of particular advantage, in particular. A first possibility consists in designing this connecting unit itself as a rigid connecting link which defines an invariable distance between the fifth and the sixth pivoting axis. A solution in which the connecting unit has two connecting links, which are articulated on one another in such a way as to be pivotable relative to one another about a seventh pivoting axis, of which a first link is articulated pivotably on the headrest unit and of which a second link is articulated pivotably on the second main link has accordingly proven to be advantageous. To achieve a sufficiently determined system, provision is furthermore made for the seventh pivoting axis, about which the connecting links are articulated on one another, to be movable in relation to the base only along a defined path. This can be achieved by means of an additional guide link, which, on the one hand, is articulated on the two connecting links in such a way as to be pivotable about the seventh pivoting axis and, on the other hand, is articulated pivotably on the base. An alternative to this would be to provide a slotted guide link or the like, in which the seventh pivoting axis would be guided.

The advantage of the connecting unit with two connecting links over the design with just one rigid connecting link consists in the influencing, thereby achievable, of the movement profile of the headrest unit in accordance with the movement of the backrest unit. By means of the system having two connecting links articulated on one another, it is thus possible to ensure that, during a forward movement of the backrest unit starting from the position of use, no movement or only slight movement of the headrest unit initially takes place. However, as soon as the headrest unit starts to move, after a delay, as the movement of the backrest unit continues, it is moved more quickly than in the case of just a rigid connecting link, with the result that it can be moved past the forward-shifted backrest unit more quickly. Thus, the movement profile of the headrest unit modified by two connecting links allows the use of larger headrest units since the speed of movement of the headrest unit is higher when the backrest unit has been moved well forward.

In a particularly preferred design, it is envisaged that the backrest unit can be moved between an initial position and a reversal position, wherein the coupling of the backrest unit to the headrest unit by means of the movement mechanism is designed in such a way that the movement of the backrest unit from the initial position into the reversal position and back into the initial position is suitable for moving the headrest unit out of the storage position into the functional position or out of the functional position into the storage position.

Thus, it is always a uniform movement of the backrest unit which, depending on the previously prevailing position of the headrest unit, brings about the transition to the respective other position. Convenience of operation is great owing to the associated simplicity. The same manner of handling the backrest unit is involved both for transfer into the storage position and for transfer into the functional position.

As a development thereof, there are fundamentally two possibilities. On the one hand, provision can be made in each case for just one of the partial movements of the backrest unit, i.e. from the initial position into the reversal position or back from the reversal position to the initial position, to be used to move the headrest unit from the storage position thereof into the functional position thereof. The respective other partial travel of the backrest would then be an idle travel which did not bring about continued movement or did not yet bring about movement of the headrest unit. This can be achieved, for example, by means of a changeover gear which brings about phased coupling or decoupling of the backrest to and from the movement mechanism of the headrest unit. In particular, it is regarded as advantageous if there is in each case a requirement for a coupled transition of the backrest unit from the initial position into the reversal position for the movement of the headrest unit from the functional position into the storage position and/or from the storage position into the functional position, while the return travel from the reversal position into the initial position takes place in the decoupled state and thus no longer has any effect on the movement of the headrest unit.

A mechanism which is simplified in comparison with the above is obtained if the backrest unit is coupled permanently to the headrest unit by means of the movement mechanism in such a way that, during the movement of the backrest unit out of the initial position into the reversal position, the headrest unit is arranged in an intermediate position between the storage position and the functional position when it reaches the reversal position. After going beyond the reversal position, the movement would then be continued in order to reach the respectively desired end position, i.e. the storage position or the functional position.

With such a design, the intermediate position mentioned of the headrest unit is a kind of dead center position, from which a continued movement of the backrest unit back into its initial position can bring about a movement of the headrest unit both in the direction of the storage position and in that of the functional position. Practical experience has shown that this indeterminacy is not necessarily disruptive. Since the headrest unit has already acquired an inherent speed owing to the partial travel achieved by movement of the backrest out of the initial position into the reversal position, it reliably goes beyond the dead center position mentioned and thereby as it were pulls the backrest unit back in the direction of its initial position.

In particular, this also allows an extremely simple movement mechanism, in which the headrest unit and the backrest unit are each provided on the item of furniture, in particular the base thereof, in such a way as to be pivotable about rotation axes, the headrest rotation axis on the one hand and the axis of the backrest unit on the other, and are connected to one another only by a rigid transmission member, which is articulated on the headrest unit and the backrest unit, eccentrically with respect to the respective rotation axis. This design is very simple, especially also when compared with known movable headrests, and leads to a haptic sensation which is perceived to be unusual and pleasant, the special feature of which is that there is the impression during actuation of the backrest unit that it is moving back into its initial position virtually automatically once it reaches the reversal position. However, this is brought about primarily by the inertia of the headrest unit. As an alternative, designs having a plurality of transmission members coupled to one another in the manner of a chain are also conceivable.

It may be advantageous on a case-by-case basis if the extremely simple mechanical design mentioned is supplemented by a changeover mechanism, which, in the region of the intermediate position mentioned and depending on the initial position of the headrest unit when transferring the latter out of the functional position into the storage position or out of the storage position into the functional position, assists movement in the direction of the end position (functional position or storage position) by means of a switching spring means, which, depending on the initial position of the headrest unit, causes a force to be imposed on the headrest unit in the direction of the respective end position. A design in which the changeover mechanism is designed in such a way that it only ever allows continuation of the movement in the direction away from the initial position (functional position or storage position) and in the direction of the end position (storage position or functional position) would also be conceivable as an alternative to this.

Behind the backrest, an item of seating furniture according to the invention can have a vertical end surface, which delimits the item of seating furniture at the rear and which, depending on the type of seating furniture, could be rigid, being made of wood for example, or upholstered. A design of an item of seating furniture according to the invention is regarded as advantageous in which the headrest unit has the headrest portion already mentioned above, which is attached to the movement mechanism by means of one or more rods, wherein said rods extend through a gap between the backrest unit and the end surface mentioned in the functional position of the headrest unit.

In addition to the item of furniture described, the invention also relates to a fitting for an item of seating furniture, in particular an item of the type described above. This fitting has a base segment for the attachment of a seating surface, a backrest segment for the attachment of a backrest, and a headrest segment for the attachment of a headrest. The backrest segment is articulated pivotably on the base segment. The headrest segment is furthermore also movable in a guided manner relative to the base segment. In this case, the backrest segment and the headrest segment are coupled mechanically in such a way that pivoting of the backrest segment brings about a movement of the headrest segment.

The three segments mentioned are rigid parts of the fitting, which each serve for the attachment of the respective parts of an item of seating furniture. The fitting is intended for use on an item of seating furniture, in particular an item of the type described above. The technical aspects mentioned in relation to the abovementioned item of furniture can also be provided on a fitting of this kind within the context of advantageous developments.

BRIEF DESCRIPTION OF THE DRAWINGS

Further aspects and advantages of the invention will emerge not only from the claims but also from the description of preferred embodiments of the invention, which are explained below by means of figures, of which:

DETAILED DESCRIPTION OF THE ILLUSTRATIVE EMBODIMENTS

Figure 1A:
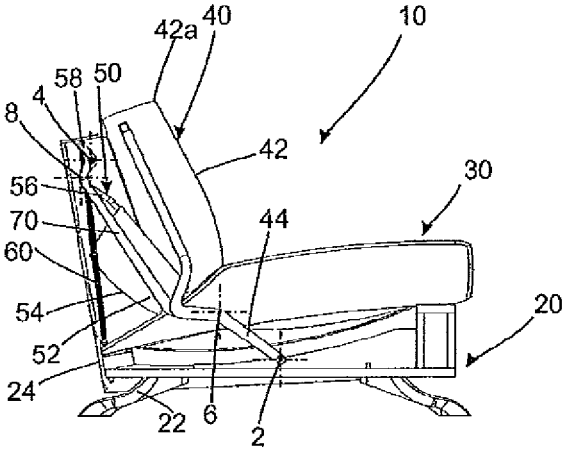
FIGS. 1*a*-1*c* show a first embodiment of an item of seating furniture according to the invention during a transition of its headrest unit from a storage position (FIG. 1*a*) into a functional position (FIG. 1*c*)
Figure 1B:
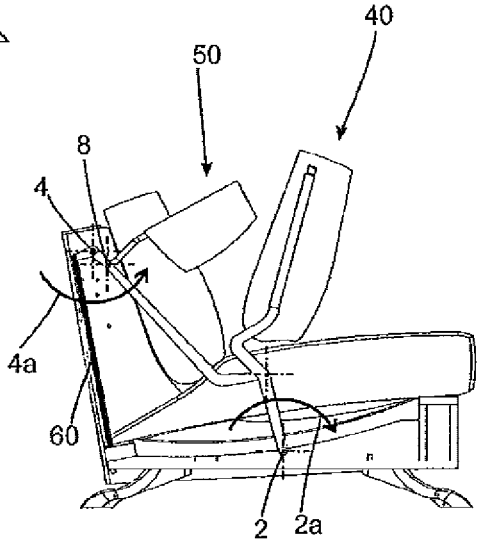
Figure 1C:
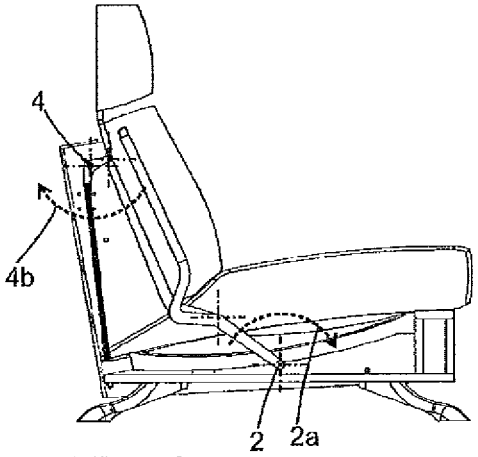

FIGS. 1*a*-1*c* show a first embodiment of an item of seating furniture 10 according to the invention in sectioned side views.

The essential components are explained by means of FIG. 1*a*. The item of seating furniture 10, which could be designed either as an armchair or a sofa, as could the items in the other illustrative embodiments, has a base 20, which is provided for standing and which serves as a reference system for relative movements described below, unless explained otherwise. In addition to standing feet 22, this base 20 also comprises a frame 24, made of wood for example, which, in particular, also forms an approximately vertical rear end surface of the item of seating furniture. The item of seating furniture 10 furthermore has an upholstered seating surface unit 30, which is arranged in a manner fixed relative to the base 10 in the design under consideration but could also be designed so as to be movable in other designs, and a backrest unit 40, which makes available an upholstered backrest surface 42 and which can be pivoted by means of a linkage 44 fixed in relation to the backrest surface about a backrest pivoting axis 2, which extends in the transverse direction of the furniture. The headrest unit 50 is provided on the rear side of the backrest unit 40. This headrest unit 50 comprises an upholstered headrest portion 52 having a head contact surface 54 and a linkage 56, which starts from the latter and which provides pivotability of the headrest unit 50 about a headrest pivoting axis 4. A bracket 58 fixed relative to said elements, on which a helical spring 60 engages eccentrically with respect to the headrest pivoting axis 4 and which is secured at the opposite end of the base 20, is also part of the headrest unit.

The components of the backrest unit 40 and of the headrest unit 50 which can each be pivoted about pivoting axes 2, 4 extending in the transverse direction of the furniture are operatively coupled to one another by a rigid transmission member 70. This transmission member 70 is designed as a metallic rod, which is articulated eccentrically on the backrest unit 40 about a pivoting axis 6 and eccentrically on the headrest unit 50 about a pivoting axis 8.

FIG. 1*a* shows a storage position of the headrest unit 50. In this position, the headrest unit 50 is arranged behind the back contact surface 42 of the backrest unit 40 in relation to a longitudinal direction of the furniture and below an upper end edge 42*a* of the back contact surface 42 in relation to a vertical direction of the furniture. Here, it is virtually invisible from the outside and causes only a slight increase, if any, in the outside dimensions of the item of furniture 10.

In order to move the headrest unit 50 into its functional position, manual handling of the backrest unit 40 is envisaged in the item of seating furniture shown. The backrest unit is pivoted manually forward in the direction of arrow 2*a* in the manner that can be seen in FIG. 1*a*, and, owing to the coupling by means of the transmission member 70, it also causes pivoting of the headrest unit 50, initially in the opposite direction, the movement of the backrest unit 40 giving the headrest unit sufficient space to pivot forward counterclockwise on the basis of the figures.

FIG. 1*b* shows an intermediate state, in which pivoting axis 2, pivoting axis 4 and pivoting axis 8 are precisely in alignment with one another. This is a dead center position, in which, disregarding the spring 60 and weight, there is an undefined state in respect of whether the headrest unit 50 will return to its storage position or be pivoted onward into the functional position when the direction of rotation 2*a* of the backrest unit is reversed. In this state, the backrest unit 40 has reached its forward reversal position. If it is then pushed back into its initial position in FIG. 1*a*, the headrest unit can therefore pivot downward or upward.

In practice, however, this does not represent a problem since, in the state in FIG. 1*b*, the headrest unit 50 is in motion in the direction of arrow 4*a*. The inertia of the headrest unit 50 ensures that the dead center position in FIG. 1*b* is overcome and the manually handled backrest unit 40 returns virtually automatically into its initial position, as illustrated in FIG. 1*c*. This figure shows the functional state of the item of seating furniture 10, which can now be used with the headrest.

If the backrest is then once again pulled forward in the direction of arrow 2*a*, starting from the state in FIG. 1*c*, the headrest unit 50 moves in the direction of arrow 4*b* and thus in the direction of its storage position. During this sequence of movement too, the dead center position in FIG. 1*b*, which is once again obtained in a similar way, is not problematic since, once again, the inertia of the headrest unit 50 ensures reliable transfer into the functional position.

In extreme cases, the very simple mechanism allows operation in the following manner: simply by a short jerky forward pulling action on the backrest unit 40, the entire transfer out of the functional position into the storage position or out of the storage position into the functional position is made possible.

The embodiment shown represents a connection of simple mechanical structure and reliable, robust functionality.

Nevertheless, there may be a desire in individual cases to make the transition motion more reliable, so that even braking of the transfer is unproblematic in a configuration corresponding to the dead center position in FIG. 1*b*. This is achieved by means of the following embodiment.

Figure 2A:
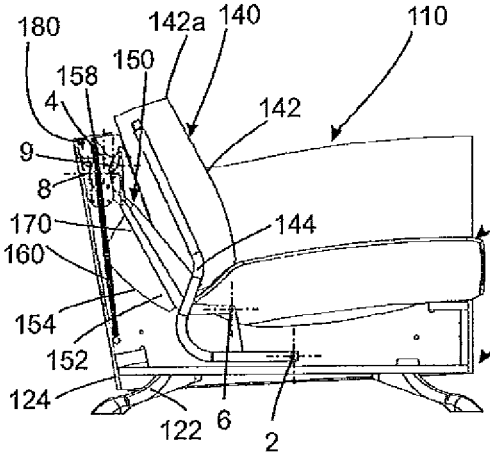
FIGS. 2*a*-2*d* show a second embodiment of an item of seating furniture according to the invention which, in addition to the components of the design in FIGS. 1*a*-1*c*, has a changeover mechanism, the purpose of which is explained below.
Figure 2B:
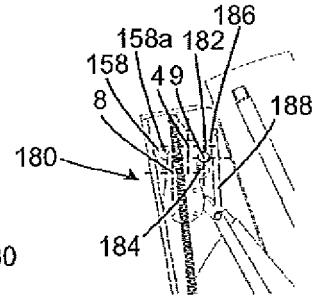
Figure 2B:
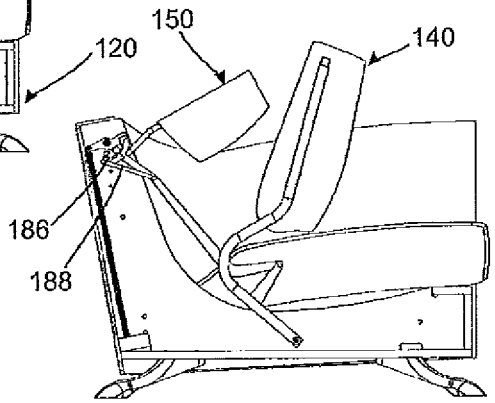
Figure 2C:
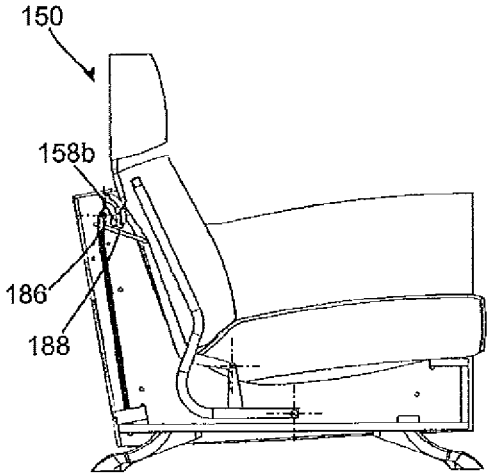
Figure 2D:
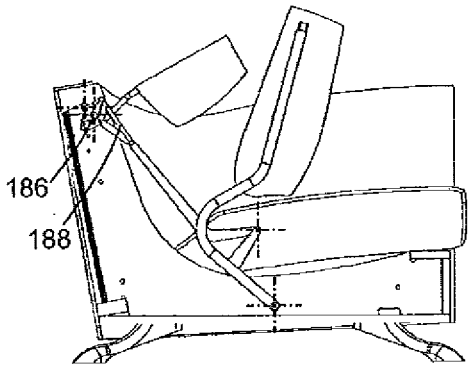

The embodiment in FIGS. 2*a*-2*d* corresponds substantially, apart from the functional difference mentioned, to that in FIG. 1*a*. Insofar as the referenced components correspond as regards the two final digits in the reference sign, these are components with a functionally identical action in relation to the present invention. Accordingly, FIGS. 2*a*-2*d* include an item of seating furniture 110, a base 120, feet 122, a seating surface unit 130, a backrest surface 142, a linkage 144, headrest portion 152, a head contact surface 154, and a spring 160. FIG. 2*d* also includes a movement mechanism 159.

Figure 2E:
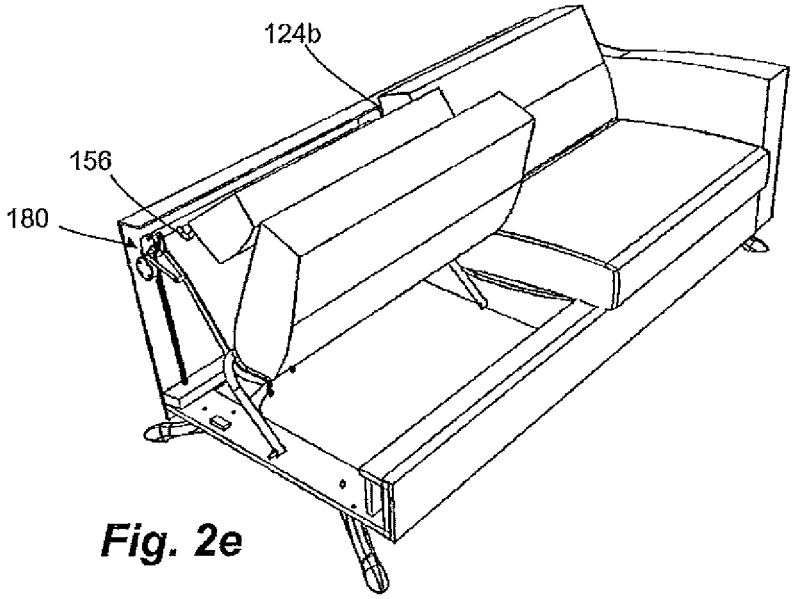
FIGS. 2*e* and 2*f* show the item of seating furniture from FIGS. 2*a*-2*d* in a partially sectioned perspective view, from which the arrangement of the changeover mechanism is clearly visible, and the changeover mechanism on an enlarged scale.
Figure 2F:
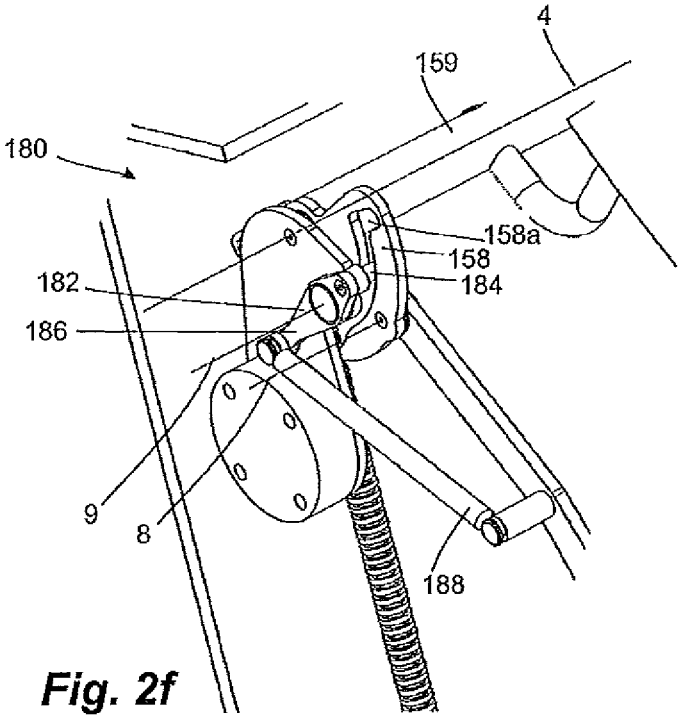

Here, the special feature consists in a changeover mechanism 180. With reference to FIG. 2*a* and FIG. 2*e*, this changeover mechanism 180 comprises a slotted disk 158, which replaces the bracket 58 in the embodiment in FIGS. 1*a*-1*c*. It fulfills all the functions which have been explained in connection with the preceding embodiment and furthermore has a guide slot 158*a*, in which a sliding block 184 is arranged. This sliding block is part of a changeover switch 182, which is articulated on the base 120 so as to be pivotable about a pivoting axis 9 parallel to pivoting axes 2, 4. On the side facing away from the sliding block 184, the changeover switch 182 has an extension arm 186, which is connected by means of a second spring 188 to the transmission member 170, which, for its part, connects the headrest unit 150 and the backrest unit 140 operatively to one another.

A sequence of movement which is explained by means of FIGS. 2*a*-2*d* is achieved by means of the design of the guide slot.

Once again, FIG. 2*a* shows an initial position, in which the headrest unit 150 is in its storage position. Once again, pivoting the backrest unit 140 forward initially indirectly causes the headrest unit 150 to pivot forward in the opposite direction, as shown by means of FIG. 2*b*. Unlike the situation with the embodiment in FIGS. 1*a*-1*c*, there is no risk in the present case of an undefined intermediate position which allows movements in both directions, i.e. in the direction of the storage position and in the direction of the functional position.

Owing to the arrangement of the rotatable changeover switch 182, which can be seen in FIG. 2*b*, the tension spring 188 acts in the direction of the functional position, given its arrangement in FIG. 2*b*. The spring 188 as it were pulls the headrest unit 150 in the direction of its functional position. That end of the spring 188 which is remote from the transmission member 170 is arranged in a manner predetermined by the pivotability of the changeover switch 182 and the arrangement of the sliding block 184.

When the functional position, illustrated in FIG. 2*c*, is reached, the changeover switch 182 is pushed into the position shown in FIG. 2*c*, wherein a stop 158*b* is provided on the slotted disk 158 to achieve this. For this purpose, the guide slot 158*a* has a widened region at its terminal end in the clockwise direction, which permits this changeover. The spring 188 thus reaches the opposite side with reference to an imaginary connecting line between pivoting axes 6, 8, ensuring that, during a subsequent transfer of the headrest unit 150 back into its storage position, the process of movement required for this is assisted by the spring 188. This is very clear from FIG. 2*d*, which is comparable to FIG. 2*b* in respect of the position of the headrest unit 150 and of the backrest unit 140. As a departure from FIG. 2*b*, however, the changeover switch 182 is now aligned approximately in the opposite direction, with the result that the spring pushes the headrest unit 150 in the direction of its storage position.

The structure of the sofa and the arrangement of the changeover device 180 can be seen more clearly in perspective view from FIG. 2*e*. Both the technical configuration of this illustrative embodiment in FIGS. 2*a* to 2*e* and the other illustrative embodiments in FIGS. 1*a* to 1*c* and 3*a* to 3*f* can be used in a similar way on a sofa divided into two or indeed on an undivided sofa or an armchair.

It can also be seen in FIG. 2*e* that the cranked design of the linkage 156 means that there need only be a narrow gap 124*b* remaining between the frame 124 and the backrest unit 140 in order to hold the headrest unit 140 in its functional position.

It can furthermore be seen from this figure that the headrest unit preferably has a torsion tube, from which the linkage 156 extends. This is connected at the end to the slotted disk 158. In the case of an embodiment having a bracket corresponding to the designs in FIGS. 1*a* to 1*c* and 3*a* to 3*f*, a torsion tube of this kind can instead be connected non-rotatably to these brackets. On such a torsion tube, the coupling to the leg rest can be provided on one side or also in duplicate and on both sides.

FIGS. 3*a*-3*f* show another embodiment of an item of seating furniture 210 according to the invention, which is designed as a sofa. In this third embodiment, those components which are of similar and functionally comparable type to those in the previous embodiments, are once again provided with reference signs which correspond with one another as regards the two last digits. Thus, the embodiment in FIGS. 3*a*-3*f* also has a base 220, a seating surface unit 230 and a backrest unit 240, which can be pivoted about a pivoting axis 2.

A headrest unit 250, which is pivotable relative to the base 220 about a pivoting axis 4, is likewise furthermore provided. The specific arrangement of said pivoting axis 4 relative to the second pivoting axis 8 provided on the bracket 258 is somewhat different to that in the embodiment in FIGS. 1*a*-1*c*, which serves the purpose explained below of achieving complete transfer of the headrest unit 250 out of its storage position in FIG. 3*a* into its functional position in FIG. 3C solely by means of a unidirectional actuating direction of the backrest unit 240.

The following differences in comparison with the embodiment in FIGS. 1*a*-1*c* are attributable to this modified manner of transfer. Thus, the embodiment in FIGS. 3*a*-3*f* likewise has a transmission member 270 which is articulated on the bracket 258 so as to be pivotable about the pivoting axis already mentioned. The opposite end of the transmission member 270 is likewise attached to the backrest unit 240 in such a way as to be pivotable about pivoting axis 6 in accordance with the embodiment in FIGS. 1*a*-1*c*. Here, however, the connection is provided by an elongate hole 272, which enables the backrest to be pivoted, starting from the functional state in FIG. 3*d*, without thereby affecting the position of the headrest unit. The elongate hole 272 thus allows decoupling in the manner explained below. Another difference with respect to the embodiment in FIGS. 1*a*-1*c* consists in a locking member 274, which is attached pivotably to the transmission member and the function of which will be explained below. The locking member 274 is articulated pivotably on the transmission member 270 and has a holding spring, which is arranged in such a way that it can stabilize the locking member 274 in two opposite end positions.

Figure 3A:
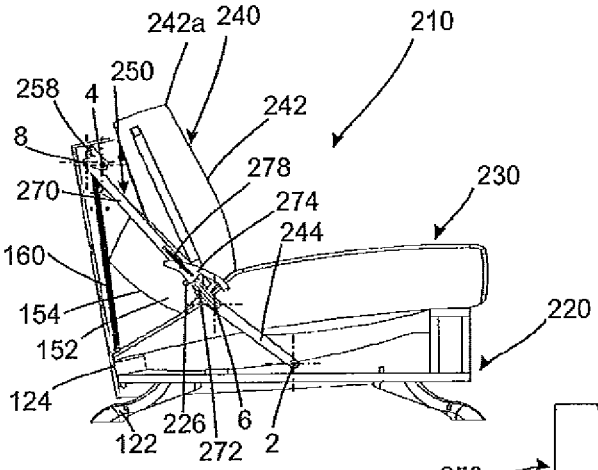
FIGS. 3*a*-3*f* show a third embodiment of an item of seating furniture according to the invention, in which the operative coupling between the backrest unit and the headrest unit is established and released in phases.
Figure 3B:
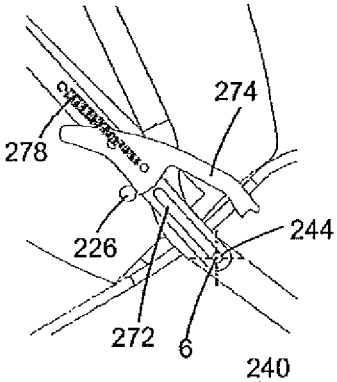
Figure 3B:
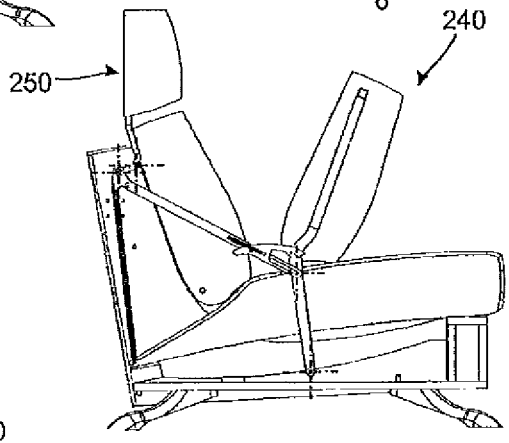
Figure 3C:
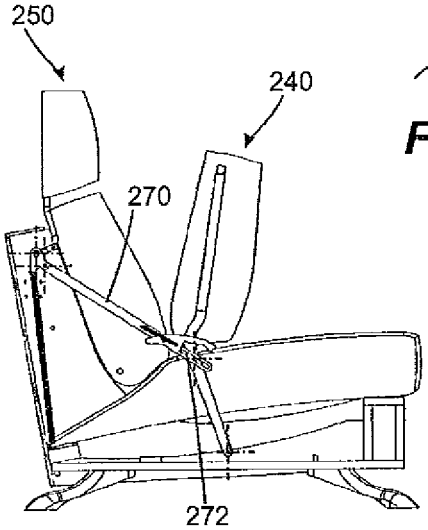

To transfer the headrest unit 250 out of its storage position into its functional position, starting from the storage position in FIG. 3*a*, the backrest unit 240 is likewise pivoted forward. Since an axle portion 244 of the backrest unit 240, which defines the pivoting axis 244, is already arranged at the distal end of the elongate hole 272 in the transmission member 270, this leads directly to concomitant pivoting of the headrest unit 250 in the opposite direction. However, the different arrangement of the pivoting axes 4, 8 from that in the embodiment in FIGS. 1*a*-1*c* has the effect that complete pivoting of the headrest unit 250 into its functional position takes place just with the movement of the backrest unit 240 out of its initial position in FIG. 3*a* into its reversal position in FIG. 3*b*.

Since a continued movement of the headrest unit 250 is not desired, there should be no interaction with the headrest unit 250 during the return transfer of the backrest unit 240 into its initial position. This purpose is served by the elongate hole 272 mentioned, which allows isolated pivoting of the backrest unit 240 in the manner illustrated by means of the intermediate position in FIG. 3*c*. Admittedly, the transmission member 270 is also pivoted. However, the bracket 258 is not subjected to any force, and therefore the position of the headrest unit 250 is not changed. Meanwhile, the headrest unit 250 is held in its functional position solely by the spring 260.

Toward the end of the return pivoting movement of the backrest unit 240, there is a changeover process. The locking member 274 is pivoted by a changeover element 226 provided in a fixed manner on the base during the idle travel of the backrest unit 240 back into its initial position, in the present case just before this initial position is reached, with the result that a holding spring 278 associated with the locking member 274 changes sides in relation to the pivoting axis of the locking member 274. The result is that the locking member 274 is moved into a modified alignment in the functional position, in which it is approximately in alignment with the transmission member 270, in the manner clearly visible from FIG. 3*d*.

Figure 3D:
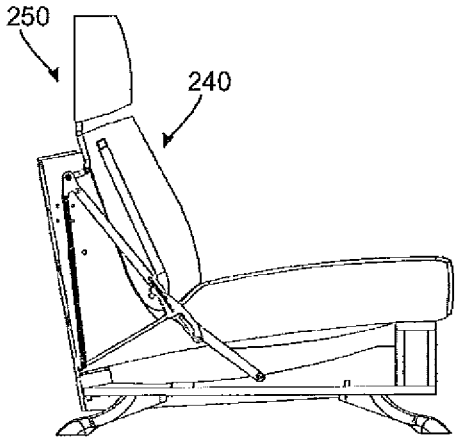
Figure 3E:
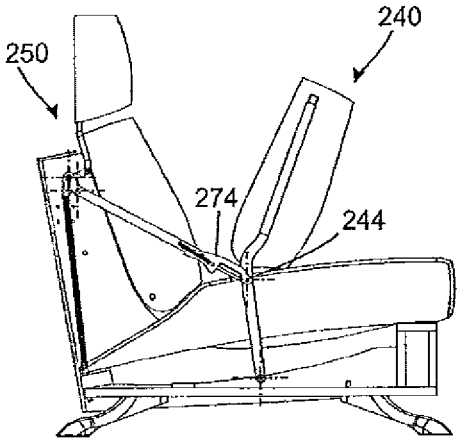
Figure 3F:
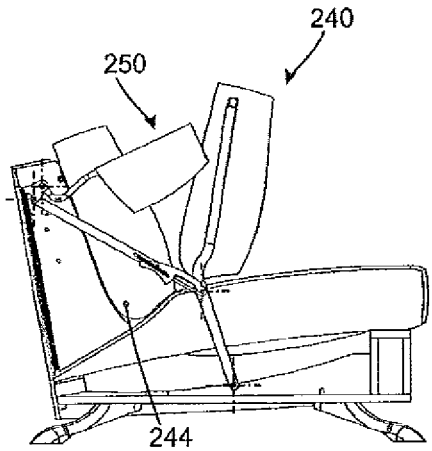

If the backrest unit 240 is then moved forward again, starting from this functional position in FIG. 3*d*, the locking member 274 snaps in on the axial extension 244 of the backrest unit at the instant shown in FIG. 3*e*, with the result that the translational relative mobility between the transmission member 270 and the backrest unit 240 previously provided by the elongate hole 272 is eliminated. The intermediate position in FIG. 3*e* accordingly signifies an intermediate position from which the mechanical situation briefly corresponds once again to that of the illustrative embodiment in FIGS. 1*a*-1*c*. If a return movement of the backrest unit 240 then takes place in the direction of its initial position, starting from the position in FIG. 3*e*, the headrest unit 250 is once again pivoted back in the direction of its storage position. At the last moment of this return pivoting movement, the locking member 274 once again strikes the changeover element 226, although with a different portion. This element tips the locking member 274 back into the initial position in FIG. 3*a*.

A complete cycle of the transfer of the headrest unit 250 out of its storage position into its functional position and back into its storage position is complete.

All three embodiments described illustrate that the system proposed here uses mechanically very simple means to make available a possibility of providing upholstered furniture with headrests without entailing an aesthetic or economic disadvantage in the storage position or the functional position.

FIGS. 4*a* to 4*d* and 5*a* to 5*f* show a fourth embodiment of an item of seating furniture according to the invention.

This fourth embodiment is distinguished by a particularly compact fitting, which is preferably made entirely of metal, by means of which the backrest pivoting axis 2 arranged far forward can be dispensed with, unlike the situation with the previous embodiments.

Figure 4A:
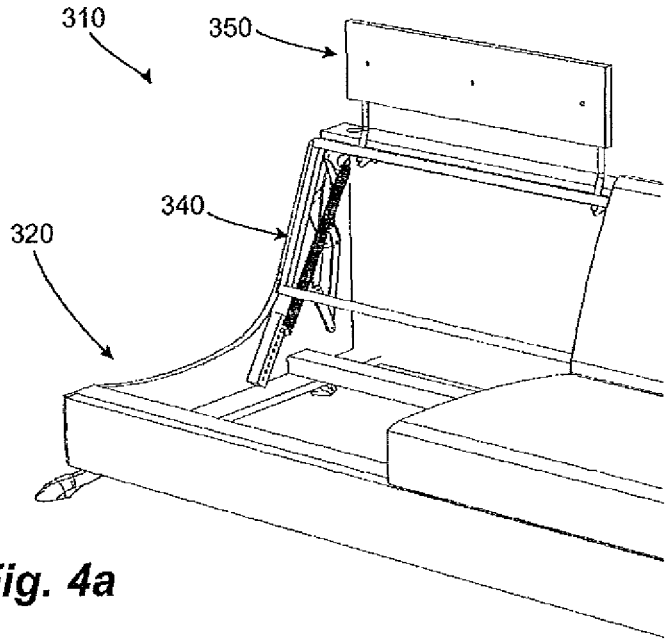
FIGS. 4*a*-4*d* show a fourth embodiment, in which the mobility of the backrest unit on the base is achieved by means of a double link system.
Figure 4B:
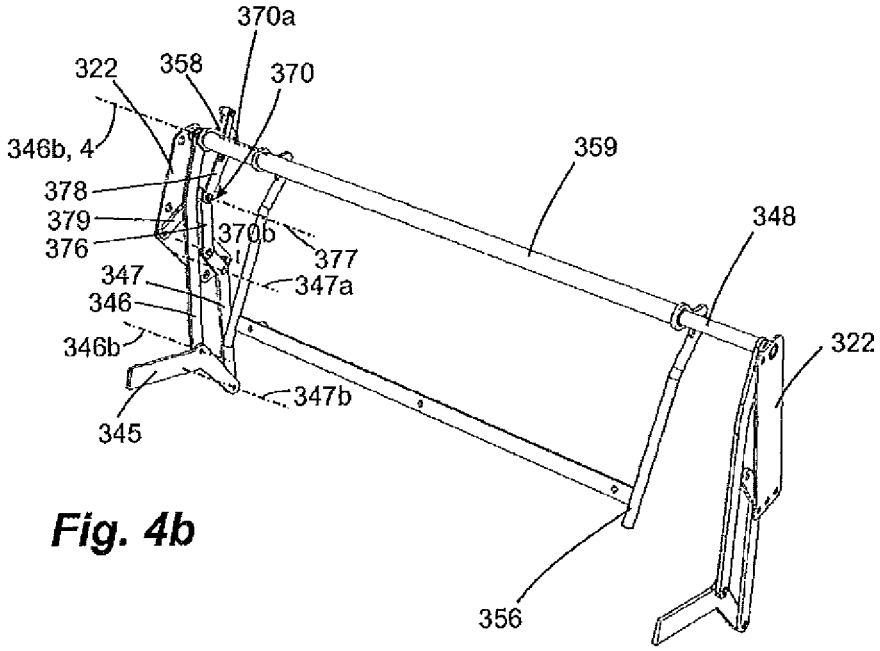

This fitting is shown in isolated form in FIG. 4*b*. The fitting comprises two plate-type mounting elements 322 for fixed mounting on the base 320 of the item of seating furniture. These mounting elements define two pivoting axes 346*a*, 347*a*, about which two main links 346 and two main links 347 in each case can be pivoted relative to the base. At the opposite end of each of the main links 346, 347, they are connected to extension arms 345 fixed on the backrest so as to be pivotable about pivoting axes 346*b*, 347*b*. The mounting elements 322, on the one hand, and the extension arms 345, on the other hand, are thus each connected by two main links 346, 347, which jointly permit the movement of the extension arms 345 and hence of the backrest unit 340 relative to the base along a defined movement path. Further details of this movement path will be given in connection with FIGS. 5*a* to 5*f*. However, it should already be mentioned at this point that the distance between the respective pivoting axes 346*a*, 346*b*, which is defined by the first main links, is significantly greater than the distance between the pivoting axes 347*a*, 347*b*, which is defined by the second main links. It is furthermore of relevance that the main links 346, 347 are aligned substantially parallel to one another in the state of the fitting shown in FIG. 4*b*, which is associated with the positioning of the backrest in its position of use.

The two first main links 346 are connected to one another by a connecting tube 348, which is aligned coaxially with pivoting axis 346*a*. Thus, it is ensured that the two first main links 346, which have a U-shaped structure owing to the connecting tube 348, can only ever be pivoted jointly.

The headrest unit 350 is also pivotable about a headrest pivoting axis 4 relative to the mounting elements 322 on the base, said axis coinciding in the present case with pivoting axis 346*a*. As a fitting component, the headrest unit 350 comprises a linkage 356, which is firmly connected to a torsion tube 359. This torsion tube 359 is pushed onto the connecting tube 348 of the first main links 346. At its left-hand end based on FIG. 4*b*, the torsion tube 359 is fixedly connected to a bracket 358, which is thus likewise pivotable about pivoting axis 4, 346*a*. The double link system, by means of which the backrest extension arm 345 is movably connected to the mounting elements 322, is coupled to the bracket 358 by a connecting system 370, which comprises two connecting links 376, 378, which are pivotable relative to one another about a pivoting axis 377. Connecting link 376 is furthermore articulated pivotably on the mounting element 322 and connecting link 378 is articulated pivotably on the bracket 358, eccentrically with respect to the headrest pivoting axis 4. In its own right, the design with two connecting links 376, 378 articulated on one another would lead to a system which was not adequately determined mechanically. Provision is therefore made to enable the position of pivoting axis 377 to move only along a defined movement path, which is indicated in FIG. 5*b* by a chain-dotted line. In the illustrative embodiment in FIGS. 4 and 5, this is achieved by means of a guide link 379, which is connected to connecting links 376, 378 in such a way as to be pivotable about pivoting axis 377 and which is attached pivotably at the other end to the mounting element 322 on the left-hand side based on FIG. 4*b*.

The use of a connecting system 370 consisting of two connecting links 376, 378 leads to a particular speed profile of the headrest unit 350 as the backrest unit 340 moves, as explained below.

Figure 4C:
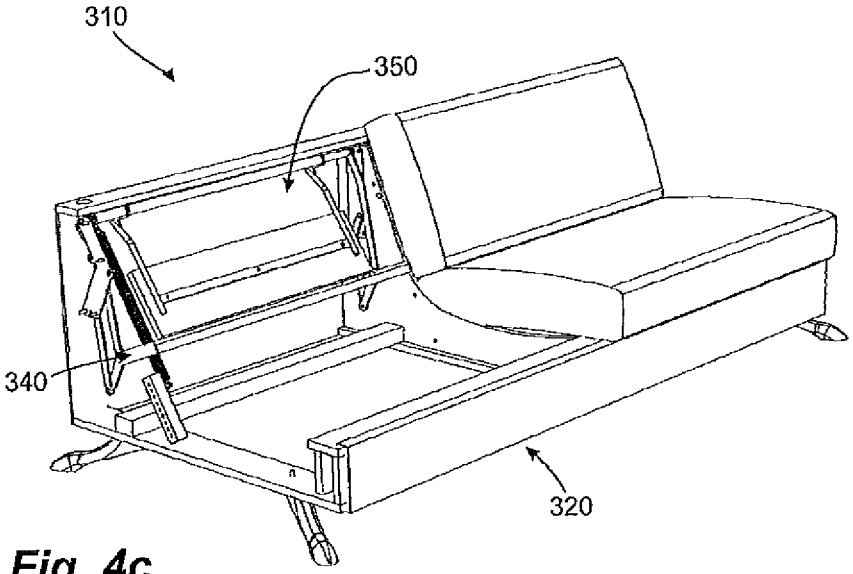
Figure 4D:
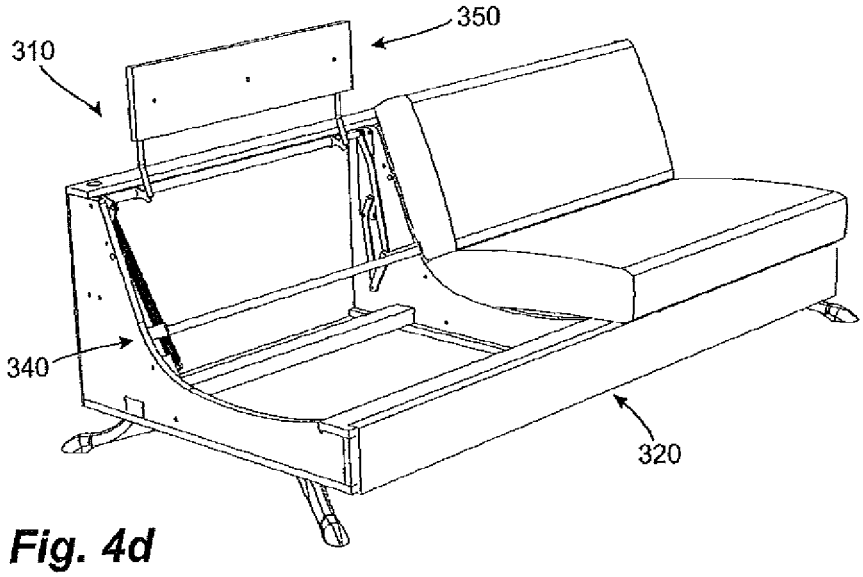

FIGS. 4*c* and 4*d*, in which, on the left-hand side of the sofa illustrated there, the seat unit 330, the backrest unit 340 and, in FIG. 4*c*, also a side cheek of the sofa depicted there are at least predominantly cut away, serve to illustrate the two end positions of the headrest unit 350. As is readily apparent from the comparison in FIGS. 4*c* and 4*d*, the two main links 376, 378 are in the same arrangement, both in the initial state in FIG. 4*c*, in which the headrest unit is in the storage position, and in the state in FIG. 4*d*, in which the headrest unit 350 is in the functional position. The compact construction of the fitting in the two end states of the movement of the headrest unit 350 can furthermore be seen here.

The transition from the storage position of the headrest unit 350 to the functional position of the headrest unit 350 is illustrated in detail by means of FIGS. 5*a* to 5*f*.

Figure 5A:
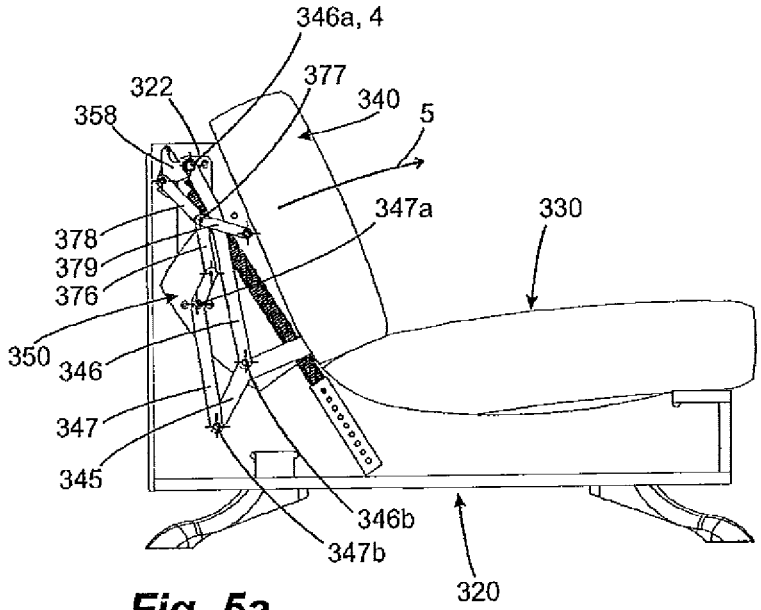
FIGS. 5*a*-5*f* show the sequence of movement in the fourth embodiment, starting from the headrest unit in the storage position, as far as the arrangement of the headrest unit in the functional position.
Figure 5B:
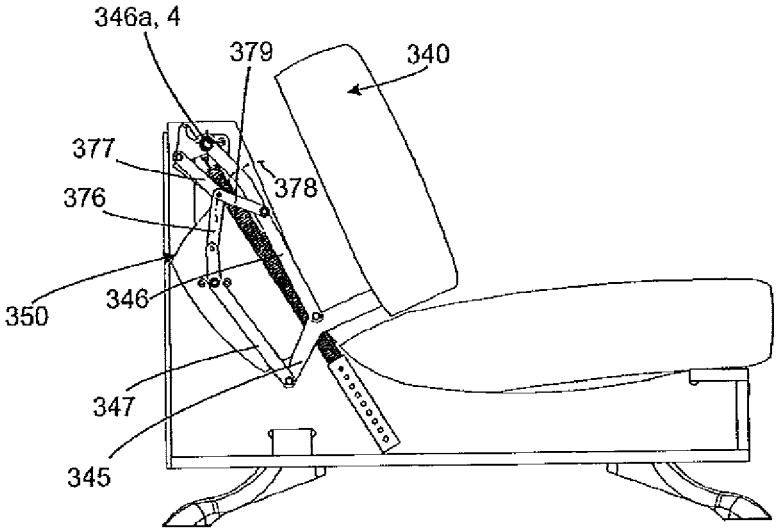

FIG. 5*a* shows the initial state. In this initial state, the headrest unit 350 is arranged on the rear side of the backrest unit 340. In order now to achieve the desired functional state, the backrest unit 340 is moved in the direction of arrow 5 by manually applying a force. The movement path results from the dimensions of the two main links 346, 347. Since these are arranged largely parallel and sloping slightly forward and downward in the initial position in FIG. 5*a*, the movement of the backrest unit 340 begins with a substantially rectilinear, forward and upward movement, as the transition from FIG. 5*a* to FIG. 5*b* shows. The headrest unit 350 initially moves only to a very slight extent clockwise. This is attributable to the special link arrangement consisting of the two connecting links 376, 377 and the guide link 379. Together, these have the effect that there is virtually no discernible pivoting of the bracket 358 initially.

Figure 5C:
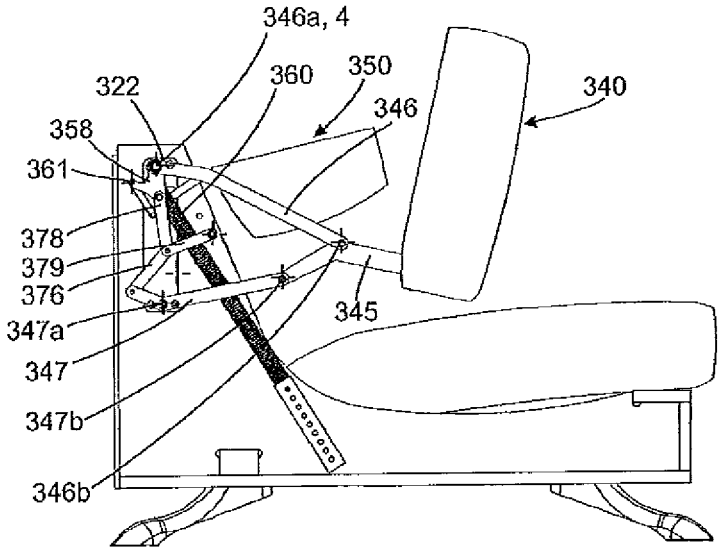
Figure 5D:
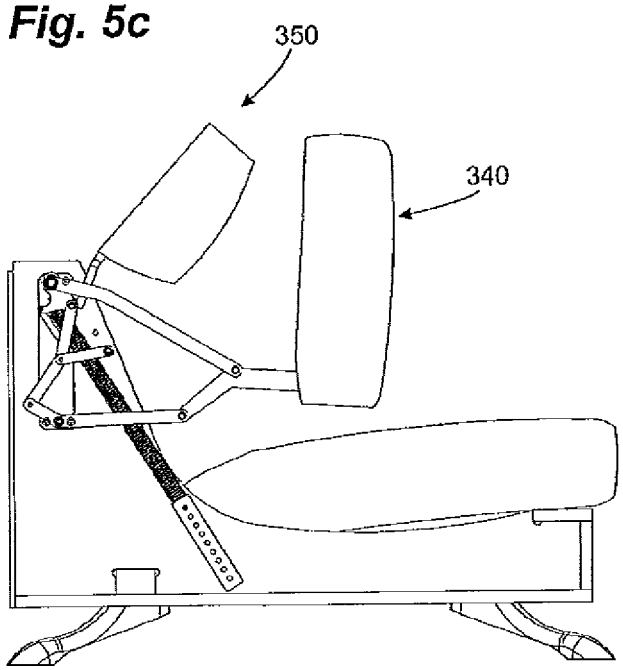
Figure 5E:
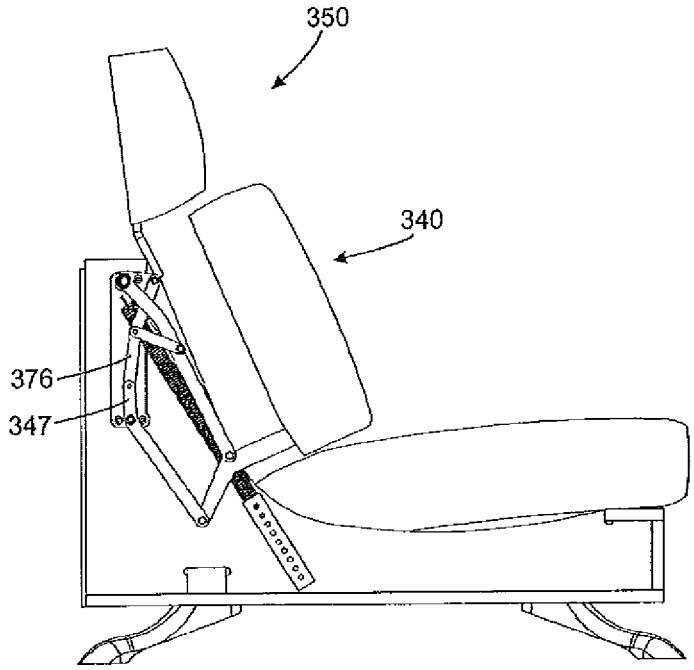

Only when continued forward movement of the backrest is brought about, starting from the state in FIG. 5*b*, is this movement of the headrest unit 350 reversed and the headrest unit 350 pivots at a relatively high speed counterclockwise about the headrest pivoting axis 4. At the same time, the backrest unit 340 tips forward to a greater extent in this phase, owing to the different lengths of the main links 346, 347, and thus makes sufficient room for the movement of the headrest unit 350. This intermediate state, which is illustrated in FIG. 5*c*, also simultaneously represents the reversal position of the backrest unit 340. When the item of furniture is in the state in FIG. 5*c*, a relevant quantity of kinetic energy is stored in the upward-pivoted headrest unit 350. Moreover, the tension spring 360 acts on the articulation point 361 on the bracket 358, which is at the maximum distance from the headrest pivoting axis 4, at right angles to the alignment of the spring 360, in the state in FIG. 5*c*, with the result that the spring also assists the continued upward pivoting movement of the headrest unit 350. The overall result thereby achieved is that the backrest unit 340 is moved back in the direction of its initial position, being pulled indirectly by the headrest unit 350. This is also illustrated by FIG. 5*d*.

Figure 5F:
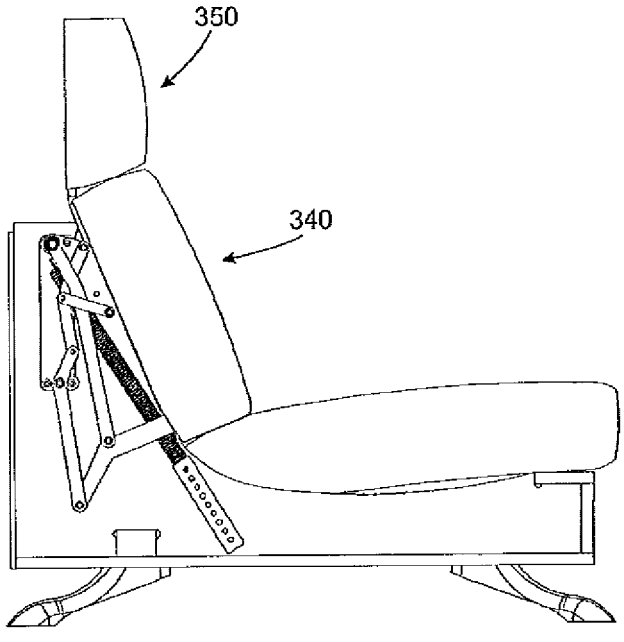

Just before the backrest unit 340 has reached its initial position again, which is simultaneously the position of use, the headrest unit 350 has already reached its functional position and even slightly exceeded it, thus allowing the backrest unit to be moved back into its position of use in FIGS. 5*a* and 5*f* without collisions. This brief exceeding of the functional position is caused by the shaping of the main link 346 and by the links 376, 378, 379.

Only at the last moment of the movement is the direction of movement of the pivotable headrest unit 350 changed again, with the result that it pivots back clockwise to a slight extent and then comes to rest on the upper end surface of the backrest unit 350.

The return transfer into the state in FIG. 5*a* is identical in terms of the movement. Once again, the backrest unit 340 is initially moved in the direction of arrow 5, thereby causing the states in FIGS. 5*a* to 5*e* to be traversed in reverse sequence until the state in FIG. 5*a*, in which the headrest unit 350 is in its storage position, is reestablished. The only relevant difference is that, during this return transfer, the movement of the headrest unit must be achieved against the force of the spring 360. However, the potential energy of the descending headrest unit 350 is additionally available for this purpose.

The invention claimed is:

1. An item of seating furniture in a form of a sofa or armchair comprising:

a base;

a seating surface unit;

a backrest unit with a back contact surface; and a headrest unit with a head contact surface;

wherein the headrest unit can be moved between a storage position and a functional position, in which the head contact surface is substantially aligned with the back contact surface;

wherein the headrest unit is arranged in such a way in the storage position that the head contact surface is arranged completely behind the back contact surface and below a top edge of the back contact surface;

wherein the headrest unit can be pivoted about a headrest rotation axis fixed in relation to the base along a nonlinear movement path, or can be moved along a linear movement path relative to the base;

wherein the backrest unit of the item of furniture can be moved relative to the base along a second movement path deviating from the nonlinear or linear movement path of the headrest unit and is provided for manual movement, wherein movement of the backrest unit is coupled to movement of the headrest unit via a movement mechanism of the headrest unit; and wherein the headrest unit can be pivoted through at least 90° about the headrest rotation axis to achieve the functional position, starting from the storage position.

2. The item of seating furniture as claimed in claim 1, wherein the movement mechanism is designed in such a way that, when the headrest unit:

is arranged in the storage position, the head contact surface encloses an angle of between 0° and 60° with a vertical, and/or is arranged in the functional position, the head contact surface encloses an angle of between 0° and 30° with a vertical.

3. The item of seating furniture as claimed in claim 1, wherein the headrest rotation axis is arranged below the top edge of the back contact surface.

4. The item of seating furniture as claimed in claim 1, wherein the headrest unit has a headrest portion on which the head contact surface is provided, wherein the headrest portion is connected to the base by at least one rod, wherein the rod extends upward through a gap between a frame of the item of seating furniture and the backrest unit in the functional position of the headrest unit.

5. The item of seating furniture as claimed in claim 1, wherein the headrest unit can be pivoted counterclockwise out of the storage position into the functional position, in a transverse direction of the furniture based on a lateral perspective, in which a seating surface of the item of seating furniture is arranged on a right-hand side of the back contact surface.

6. The item of seating furniture as claimed in claim 1, wherein a spring is provided, by which the headrest unit is permanently subjected to a force in a direction of the functional position.

7. The item of seating furniture as claimed in claim 1, wherein the headrest unit is arranged in such a way in the storage position that at least the head contact surface facing forward in the functional position is not visible from an outside in the storage position of the headrest unit.

8. The item of seating furniture as claimed in claim 1, wherein the backrest unit is movably connected to the base by at least two main links, including a first main link and a second main link, wherein:

the first main link can be pivoted about a first pivoting axis fixed in relation to the base and about a second pivoting axis fixed in relation to the backrest unit; and the second main link can be pivoted about a third pivoting axis fixed in relation to the base and about a fourth pivoting axis fixed in relation to the backrest unit.

9. The item of seating furniture as claimed in claim 8, wherein:

the main links are aligned substantially parallel to one another in the storage position of the headrest unit; and/or the first main link is at least 20% longer than the second main link.

10. The item of seating furniture as claimed in claim 8, wherein a connecting unit is provided between the second main link and the headrest unit, which is attached to the second main link in such a way as to be pivotable about a fifth pivoting axis offset relative to the third pivoting axis and which is attached to the headrest unit in such a way as to be pivotable about a sixth pivoting axis offset relative to the headrest rotation axis, wherein:

the connecting unit is designed as a rigid connecting link which defines an invariable distance between the fifth pivoting axis and the sixth pivoting axis; or the connecting unit has two connecting links, including a first connecting link and a second connecting link, which are articulated on one another in such a way as to be pivotable relative to one another about a seventh pivoting axis, of which the first connecting link is articulated pivotably on the headrest unit and of which the second connecting link is articulated pivotably on the second main link, wherein the seventh pivoting axis can be moved in relation to the base only along a defined path.

11. The item of seating furniture as claimed in claim 8, wherein at least two first and/or at least two second main links are provided, wherein the at least two first and/or at least two second main links are pivotable relative to the base and relative to the backrest unit about respectively identical pivoting axes, and wherein the at least two first and/or at least two second main links are connected rigidly to one another by a connecting rod or a connecting tube.

12. The item of seating furniture as claimed in claim 11, wherein the headrest unit has a torsion tube, within which the connecting rod or the connecting tube connecting the at least two first or at least two second main links extends.

13. The item of seating furniture as claimed in claim 1, wherein the backrest unit can be moved between an initial position and a reversal position, wherein a coupling of the backrest unit to the headrest unit by the movement mechanism is designed in such a way that movement of the backrest unit from the initial position into the reversal position and back into the initial position is suitable for moving the headrest unit out of the storage position into the functional position or out of the functional position into the storage position.

14. The item of seating furniture as claimed in claim 13, wherein the backrest unit is connected in phases to the movement mechanism of the headrest unit and decoupled in phases from the movement mechanism of the headrest unit during transfer from the initial position, via the reversal position, back into the initial position.

15. The item of seating furniture as claimed in claim 14, wherein the backrest unit is coupled to the headrest unit in phases in such a way that:

transfer of the headrest unit from the storage position into the functional position can be achieved only by moving the backrest unit from the initial position into the reversal position, while the headrest unit is decoupled from the backrest unit during subsequent movement of the backrest unit into the initial position; and/or transfer of the headrest unit from the functional position into the storage position can be achieved only by moving the backrest unit from the initial position into the reversal position, while the headrest unit is decoupled from the backrest unit during subsequent movement of the backrest unit into the initial position.

16. The item of seating furniture as claimed in claim 13, wherein the backrest unit is coupled permanently to the headrest unit by the movement mechanism in such a way that, during movement of the backrest unit out of the initial position into the reversal position, the headrest unit is arranged in an intermediate position between the storage position and the functional position when the backrest unit reaches the reversal position.

17. The item of seating furniture as claimed in claim 16, wherein the movement mechanism comprises a changeover mechanism, which, in a region of the intermediate position and depending on the initial position when transferring the headrest unit out of the functional position into the storage position or out of the storage position into the functional position, either:

assists movement in a direction of an end position by a switching spring, which, depending on the initial position of the headrest unit, causes a force to be imposed on the headrest unit in a direction of a respectively opposite end position; or allows continuation of movement only in a direction away from the initial position and in the direction of the end position.

18. An item of seating furniture in a form of a sofa or armchair comprising:

a base;

a seating surface unit;

a backrest unit with a back contact surface; and a headrest unit with a head contact surface;

wherein the headrest unit can be moved between a storage position and a functional position, in which the head contact surface is substantially aligned with the back contact surface; and wherein the headrest unit is arranged in such a way in the storage position that the head contact surface is arranged completely behind the back contact surface and below a top edge of the back contact surface;

wherein the headrest unit can be pivoted about a headrest rotation axis fixed in relation to the base along a nonlinear movement path, or can be moved along a linear movement path relative to the base;

wherein the backrest unit of the item of furniture can be moved relative to the base along a second movement path deviating from the nonlinear or linear movement path of the headrest unit and is provided for manual movement, wherein movement of the backrest unit is coupled to movement of the headrest unit via a movement mechanism of the headrest unit; and wherein the headrest unit is pivotably movable about the headrest rotation axis, the backrest unit is pivotably movable about a backrest unit axis, and the movement mechanism comprises a transmission member, which is attached to the headrest unit and the backrest unit in each case eccentrically with respect to the headrest rotation axis and eccentrically with respect to the backrest unit axis, respectively.

19. A fitting for an item of seating furniture comprising:

a base segment for an attachment of a seating surface; and a backrest segment for the attachment of a backrest;

wherein the backrest segment is articulated pivotably on the base segment;

wherein the fitting has a headrest segment for the attachment of a headrest, which segment is movable in a guided manner relative to the base segment;

wherein the backrest segment and the headrest segment are coupled mechanically in such a way that pivoting of the backrest segment brings about a movement of the headrest segment;

wherein the headrest segment can be pivoted about a headrest rotation axis fixed in relation to the base segment along a nonlinear movement path, or can be moved along a linear movement path relative to the base segment;

wherein the headrest segment can be moved between a storage position and a functional position; and wherein the headrest segment can be pivoted through at least 90° about the headrest rotation axis to achieve the functional position, starting from the storage position.

* * * * *